United States Patent [19]

Rankin et al.

[11] Patent Number: 4,844,161

[45] Date of Patent: Jul. 4, 1989

[54] LOCKING ORIENTATION SUB AND ALIGNMENT HOUSING FOR DRILL PIPE CONVEYED LOGGING SYSTEM

[75] Inventors: E. Edward Rankin, Fort Worth; Donald E. Hensley; Martin L. Tomek, both of Houston, all of Tex.

[73] Assignee: Halliburton Logging Services, Inc., Houston, Tex.

[21] Appl. No.: 233,403

[22] Filed: Aug. 18, 1988

[51] Int. Cl.[4] ..... E21B 47/00

[52] U.S. Cl. ..... 166/250; 166/65.1; 166/383; 73/151

[58] Field of Search ..... 166/65.1, 66, 250, 381, 166/383; 73/151

[56] References Cited

U.S. PATENT DOCUMENTS

| | | | |
|---|---|---|---|
| 4,570,709 | 2/1986 | Wittrisch | 166/65.1 X |
| 4,597,440 | 7/1986 | Pottier | 166/250 |
| 4,697,638 | 10/1987 | Knight | 166/65.1 |

*Primary Examiner*—William P. Neuder
*Attorney, Agent, or Firm*—William J. Beard

[57] ABSTRACT

A method and apparatus for drill pipe conveyed logging is disclosed. In a highly deviated well borehole, the apparatus comprises a hollow housing for surrounding a logging tool, lockable and releasable rotating connector joined to said housing, and weights along one side to rotate said housing against or relative to the low side of the deviated well bore. The rotating connector includes a telescoping sleeve, and can move downwardly to lock abutting shoulders, or move upwardly to permit logging tool rotation. A nonconductor housing rotatably locks with a hollow nut and compressed rings. The housing has aligned SP electrode windows aligning with SP electrodes to operate through the housing. A male wet connector enclosed in a sealed capsule is affixed at the top end of the housing and is electrically connected to the logging tool. A cooperative female wet connector in a similar closed capsule is supported on a logging cable. The logging cable is pumped down, mechanical connection is made, separate electrical connection between the mating connectors is made, and drilling fluid is excluded by virtue of positioning the mating connectors in separate closed capsules which are filled with a selected insulating liquid. A method of operation for connection and disconnection is also disclosed.

20 Claims, 2 Drawing Sheets

LOCKING ORIENTATION SUB AND ALIGNMENT HOUSING FOR DRILL PIPE CONVEYED LOGGING SYSTEM

BACKGROUND OF THE DISCLOSURE

This disclosure is related to U.S. pat. application ser. no. 111,758 filed Oct. 23, 1987.

Ordinarily, gravity is used to pull logging tools along and into a well borehole for conducting logging operations. When a well is highly deviated, the gravity vector may not draw the logging tool through a deviated portion of the well. Many oil wells are deviated; this is particularly the case at an offshore platform where many wells are drilled from the platform into a targeted formation. While some of the wells might be approximately vertical, most of the wells extending from the platform will deviate at various angles into the formations of interest and some may involve deviations as high as about 75°. Gravity conveyed logging tools supported on wirelines do not necessarily traverse the deviated hole to the zone to be logged. Rather, the logging tool must be pushed through the deviated well to the zone of interest to assure that the logging tool is located at the requisite location in the deviated hole. It is desirable therefore that the logging tool be fixed to the end of a string of drill pipe to assure measurements along the deviated well and orientation of the logging tool at the zone of interest.

In a deviated well, the logging tool must be initially positioned in the open borehole to assure that the logged data is properly referenced to the zone of interest. In a vertical borehole, the logging tool typically will be positioned axially of the borehole. In fact, successful logging can be obtained with tools which are centralized in the open borehole and also for those which are forced to the side of the borehole for decentralized operation. The present system is particularly able to support all types of tools in a logging tool assembly and position the decentralized tools so that they are located in a known position relative to the gravity vector.

Consider a deviated well where the well is more than 10,000 feet from well head drilling apparatus to the zone of interest. Assume further that the deviated portion of the well is at a high angle, perhaps as high as 75° or 80° with respect to vertical. The high side of the hole with respect to the gravity vector is the top of the borehole while the low side is the bottom of the deviated borehole. In this example, if one desires to position a logging tool in the deviated region, the logging tool is positioned so that the decentralized tool faces the low side of the deviated borehole. Should the tool be at some other angle, then rotation of up to 180° must be imparted to the logging tool. This has been handled in the past by incorporating some kind of motor between the drill string and the logging tool. The motor is rotated to thereby rotate the logging tool until it is properly positioned relative to the gravity vector. If the motor is omitted, the entire drill string can be rotated from the well head. This is not particularly desirable because rotation from the well head may require substantial rotation on the drill string before the logging tool is rotated. The drill string comprised of steel pipe responds as a resilient member and may absorb some rotation and thus will not deliver the required rotation in a controllable fashion. In other words, carefully calculated rotation cannot always be imparted from the well head to the logging tool through the resilient drill string. Rather, the rotation of the tool will be irregular, subject to snagging, or the rotation may be absorbed entirely in the drill string. It is a matter of chance that the drill string can manipulate the logging tool to the proper decentralized orientation relative to the high side and low side of the deviated well.

The present invention sets forth a method and apparatus in which the logging tool can be positioned so that the high side of the hole is properly oriented to the high side of the logging tool. The present apparatus supports a logging tool so that it seeks the low side of the hole and stays oriented at all times in the deviated well. By contrast in the vertical wells, azimuthal orientation is not usually important. When the deviated portions are encountered, the present apparatus positions at all times the logging tool so that it is decentralized and positioned against the low side of the borehole. This is true without regard to the angle of deviation. That is, it can be used where the well is deviated perhaps only 30° but it also can be used where the deviation approaches the horizontal. The drill string is assembled with a side entry sub located in the drill string. The side entry sub is positioned in the drill string at a specified depth, as will be explained, below the well head. The drill string is maneuvered until the logging tool is at the start of the zone of interest. Then, the mud flow through the drill string is used to force a wet connector with associated apparatus along the drill string to land in contact with the mating connector at the logging tool. This deferred connection of the electrical conductor with the logging tool permits all the maneuvers to be completed prior to the actual logging sequence. Thus, the logging tool is at the zone of interest, poised for logging sequences to be conducted in that zone, properly oriented with respect to the gravity vector, appropriately decentralized, and positioned against the low side of the deviated well. At this juncture, the next step is to begin adding drill pipe to the string at the surface to force the logging tool through the zone of interest. Connection is made and the logging procedure is then started. When the wet connector is pumped down, there is no need to reposition the logging tool because the position is already assured relative to the zone of interest. Ordinarily, logging proceeds by retrieving the logging tool from the borehole. Assume as an example that the zone of interest encompasses 500 feet of the deviated well. The logging tool is initially pushed to the top of the 500 foot zone, the wet connector is pumped down, connection is made, and then 500 feet of drill pipe is added and pushed beyond the 500 foot zone. Then 500 foot of drill pipe is removed at the surface during logging on tool retrieval. The drill pipe is first simply pushed into and then pulled from the deviated well. This pushes the properly oriented logging tool to the end of the 500 foot zone. Then, the 500 foot of drill pipe is removed one joint at a time as the logging tool is pulled back through the 500 foot zone of interest. Logging occurs at the necessary locations appropriate for the investigation. At all points in time, the logging tool is properly oriented relative to the gravity vector in the zone of interest so that it is positioned for obtaining data with proper orientation. As noted above, this orientation also includes proper contact relative to the walls of the open borehole which controls tool standoff to the formation.

The present disclosure is as a drill pipe conveyed logging (DPCL) system which supports a logging tool in a protective housing equipped with rotary standoffs to control standoff spacing. The housing is aligned with the drill pipe and encloses the logging tool on the interior. The housing protects the entire tool except that certain portions are cut away. This permits backup shoes to extend from the housing. The backup arm (caliper) is used to measure the diameter of the borehole. Normally, it does decentralize the logging tool. However, decentralization is achieved by other means. Moreover, the logging tool is forced to the low side of the deviated well by incorporation of a low side weight system therein. This in conjunction with the rotary standoffs assures proper orientation.

The drill pipe conveyed logging system incorporates a locking orientation sub. It likewise includes an alignment housing. The string of drill pipe pushes the DPLS into the open hole region typically moving almost horizontally in the deviated portion. Ordinarily, no rotation is applied at this time so that the housing at the end of the drill pipe string is forced to advance into the open hole without rotation. The very bottom end of the string of drill pipe incorporates a circular standoff mechanism. It is a locking orientation sub which is constructed to connect with the drill string thereabove and hence which rotates with the drill string. At the time of installation, the standoff rides relatively high on a telescoping sleeve. During retrieval of this drill pipe string, it will ride down to the bottom and thus reflect that it has two positions, an up position during run-in and a down position during retrieval. During run-in, the housing therebelow is free to rotate. The orientation swivel thus connects to a pair of concentric sleeves the inner sleeve being fixedly connected with the drill string thereabove, and the outer sleeve being mounted on the inner sleeve with bearing means to permit rotation. During retrieval the rotary standoff is forced downwardly by a drag and moves into a position where locking shoulders abut and thereby permit only limited rotation. During retreival, the housing is constructed with weights on one side thereof which, in a deviated well, tends to fall to the low side and which creates rotation. This rotation is relatively limited. It rotates the housing which surrounds the logging tool which assures positioning of the heavy side of the housing at the lower side, the rotation being accomplished downhole substantially without requiring rotation from the top end of the drill string. Often, it is necessary to rotate the drill string several turns at the wellhead to accomplish limited rotation at the logging instruments. In that instance, it is desirable only to position the logging instruments with a particular vertical orientation.

The present disclosure also sets forth an external housing for the logging tool which has portions thereof made of nonconducting materials such as fiberglas or the like. They are constructed with appropriate openings located in the housing to enable spontaneous potential sensitive electrodes to extend through the housing. The SP electrodes are constructed on the exterior of the logging tool and extend through the nonconductive material. It is necessary to align the logging tool within the surrounding housing and to this end, the apparatus includes means for positioning the SP electrodes at sized openings in the surrounding housing so that the logging tool is properly aligned. Once alignment is achieved, the same structure can thereafter be tightened to snugly lock the housing in alignment with the SP electrodes which extend from the logging tool.

DRAWINGS

So that the manner in which the above recited features, advantages and objects of the present invention are attained and can be understood in detail, more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Figure 1:
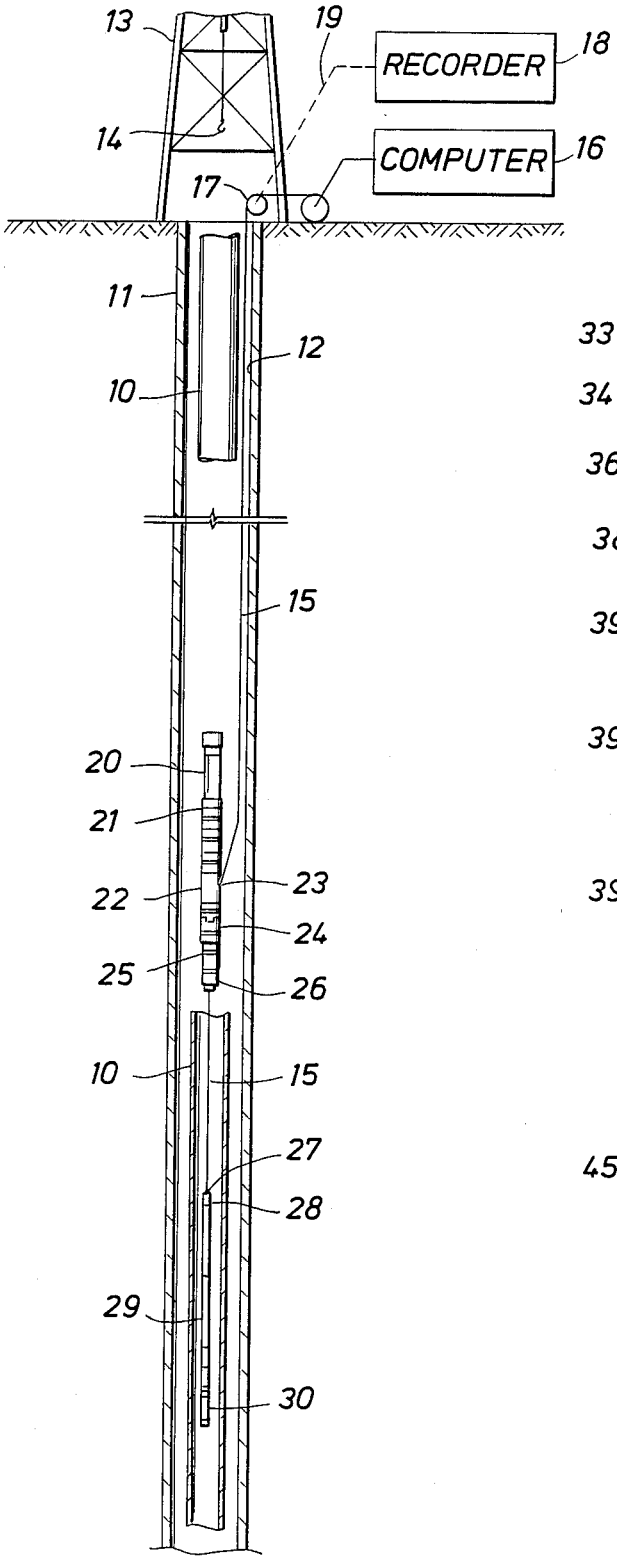
FIG. 1 shows a drill string in a borehole for conducting logging operations in a deviated well wherein the drill string incorporates a side entry sub enabling a logging cable to extend to the interior of the drill string and thereby position a female wet connector to be pumped along the drill string.

In FIG. 1 of the drawings, the numeral 10 identifies a drill string in a well 11, the well being lined with casing 12 to a specified depth. The drill string 10 is supported by a derrick 13 with a draw works 14 to be raised and lowered. Through the use of suitable mud pumps (not shown), drilling mud is pumped into the drill string 10 and flows through the drill string to carry out drilling operations. In the arrangement shown in FIG. 1, the drilling has been interrupted and a logging sequence has been initiated. The equipment located at the derrick 13 also includes a multiconductor logging cable 15 which connects with a computer 16 for processing the data provided over the multiple conductors typically found in the logging cable 15. The logging cable passes over a sheave 17 and depth of cable is transmitted to a recorder 18 by means of a depth measuring apparatus 19. The cable length is measured to ascertain the depth of the logging tool. An alternate mode of depth measurement is to tape the drill string 10 and thereby calculate the depth of the logging tool in the well 11. The lower portion of the drill string 10 threads to a tool joint 20 which threads to an actuator section 21 connected above a side entry sub 22. The side entry sub 22 has a port 23 which permits the logging cable 15 on the exterior of the drill string 10 to pass through the port and in to the interior of the drill pipe. In other words, the cable 15 is both on the exterior and the interior of the drill string. Crossover is made at the side entry sub 22. This positions a connector to be described in the drill string. The side entry sub is just above a release section 24 which then connects with an installation sub assembly 25 and that in turn connects with another tool joint of conventional construction indicated at 26. This tool joint enables continuation of the drill string 10 with conventional joints of drill pipe having a specified internal diameter.

FIG. 1 further shows the logging cable 15 on the interior of the drill string. It supports a fishing neck 27 which in turn is adjacent to an enlargement serving as a piston 28. The enlargement 28 is fairly large compared with the ID of the drill string so that drilling mud pumped down through the drill string 10 will force the piston downwardly. The enlargement 28 supports a weight bar 29 to provide adequate weight on the female wet connector 30 at the lower end. The connector 30 incorporates a set of mating electrical contacts sufficient to provide multiple signal paths out of the drill string. Moreover, the weight bar urges the female connector into coacting joinder with a male connector to assure proper match of the electrical contacts. The female connector 30 is thus forced through the drill string to the lower end for connection with the apparatus shown in FIG. 2. It should be further noted that the side entry sub 22 is ideally located in the cased portion of the well which is generally vertical. This location avoids exposing the logging cable 15 to the risk of abrasion on exposure in open hole conditions. Typically, the casing 12 extends down to a specified depth and for that reason, it is desirable that the side entry sub be confined in the cased region and not expose the cable to open hole conditions therebelow. Typically, the side entry sub is spaced along the drill string below the well head by a distance limited by the depth of casing 12 in the well 11.

Figure 2:
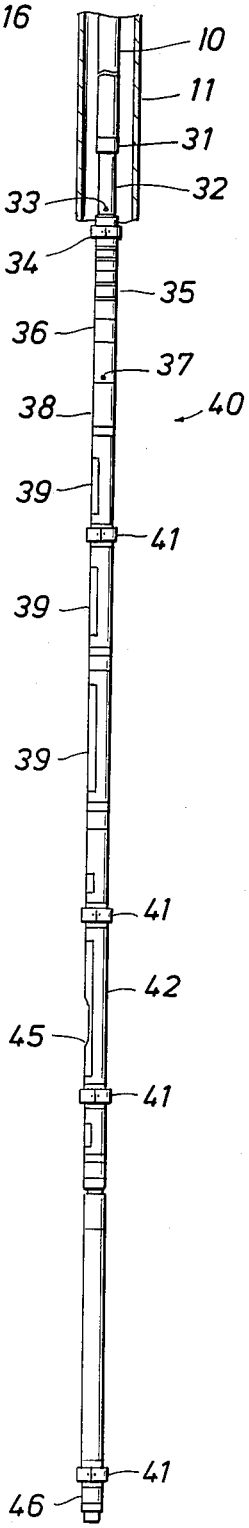
FIG. 2 is an external view of the protective housing affixed to the lower end of a string of drill pipe and adapted to conduct logging operations in a deviated well.

Going now to FIG. 2 of the drawings, the well is shown with the drill string 10 therein. At this juncture, the well can be vertical but it can just as readily be highly deviated and for purposes of description, it will be assumed that the left side of FIG. 2 is the low side of the deviated well while the high side is at the right. The angle of deviation can be any angle which is typically encountered, and indeed, the hole 11 can be horizontal at this region. Assuming that the hole is highly deviated or even horizontal, the left side of FIG. 2 will be described as the low side or the side at which the decentralized tool is positioned. The high side is the opposite side or the right hand of FIG. 2.

Figure 3:
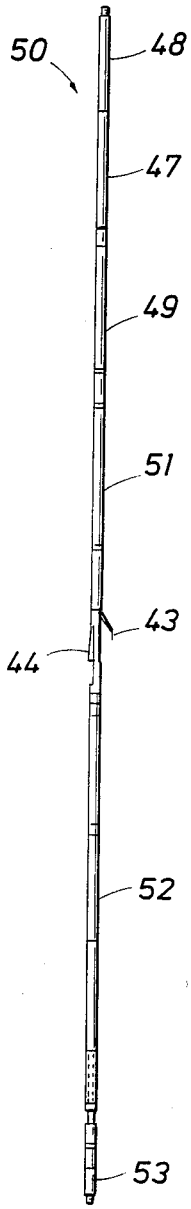
FIG. 3 is a view of the logging tool inserted into the protective housing shown in FIG. 2.
Figure 4:
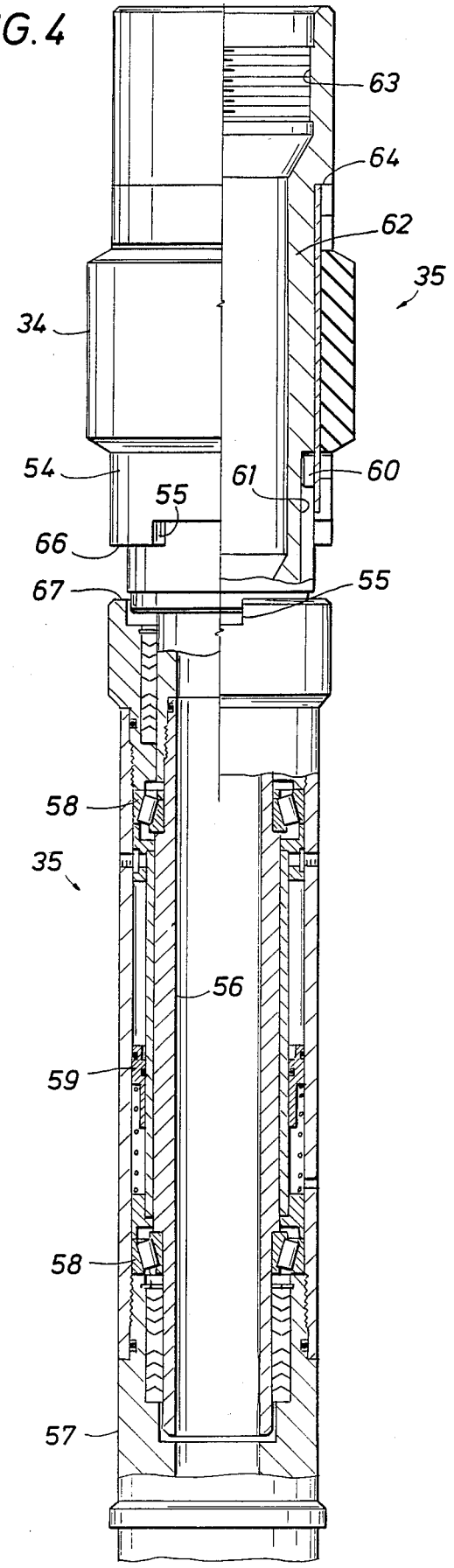
FIG. 4 is a sectional view through a locking orientation sub including an upper centralizer portion and rotatable sleeve in the protective housing.

Assuming for purposes of description that the structure shown in FIG. 2 is on its side with the right hand side of FIG. 2 being the high side, the drill string connects with a tool joint 31 which in turn joins to a handling sub assembly 32 having circulation ports therein identified at 33. This permits mud to escape out of the tool string. There is an encircling standoff assembly 34. FIG. 4 will be discussed in detail to explain more about these components. The standoff assembly 34 can be locked against rotation. It supports an orientation sub assembly 35. That in turn joins to the protective housing 40 which encloses the logging tool 50 better shown in FIG. 3. Going back to FIG. 2, however, the orientation sub assembly 35 connects serially to a centralizing section 36 for centralizing the female wet connector 30 supported on the logging cable 15. The male connector is located at the lower end of the centralizing section 36. Circulation ports 37 are below the male connector.

The protective housing 40 includes an external cylindrical shell 38 of substantial length. At selected locations, it supports several counterweights 39 at the left. The counterweights 39 have the form of a semicircular saddle. The weights assure rotation to the bottom side of the deviated well. The cylindrical shell 38 preferably does not touch the sidewall of the borehole. Contact is provided by several rotating standoff assemblies 41 at several locations. The various standoffs are interspersed along the length of the protective housing so that physical contact is limited to the standoff assemblies. In the event that they wear, they can be readily replaced without having to replace the elongate cylindrical shell 38 of the protective housing. The counterweights can also be located on the exterior and serve as scuff surfaces which are wear resistant.

The housing shell 38 comprises a protective cylindrical shroud or housing which receives the logging tool 50 on the interior. The housing is made of metal or other materials depending on the nature of the tool as will be discussed. Normally, the tool 50 is centralized on the interior of the housing 40. However, the housing itself may not be centralized with respect to the well 11 so that the tool 50 is normally positioned on the low side of the open hole, and particular logging tools are brought into close contact with the sidewall. This is accomplished at the region where appropriate slots are formed in the housing 38. There is an arm slot 42 which enables a cooperative projecting arm 43 to extend therethrough. The arm 43 is shown in FIG. 3 and is deployed outwardly. This positions a pad assembly 44 against the low side of the well 11. It is forced against the sidewall to assure proper contact and thereby obtain logging information. The pad 44 is permitted to extend through the conforming and shaped opening 45 which is opposite the arm slot 42 previously mentioned. The respective slots are located between closely spaced rotating standoff assemblies 41 to assure that the pads and arms are able to move properly into the necessary positions for proper contact.

The assembly shown in FIG. 2 terminates at a nose cone assembly 46 at the lower end. Conveniently, the protective housing 40 can have a length of perhaps upwards of 30 feet or so depending on the length of the various logging tools placed on the interior. This length can be increased to accommodate an increase in logging tool 50 length.

The logging tool 50 includes an upper section which is a telemetry section 48. It in turn connects with several different tools. As an example but not as a limitation, one such tool is a natural gamma ray measuring apparatus 47. Another is a dual spaced neutron measuring tool 49. A spectral density tool 51 is also included and is a device which utilizes the arm 43 along with the pad 44 which protrudes out of the housing. The housing is provided with the appropriate slots. The several components which make up the logging tool 50 also include a dual induction log tool 52 provided with a short guard 53 at the lower end. Again, the precise combination of logging tools included in the logging tool 50 can be varied so that the length can be varied, and the tools can be characterized as those which require pads in contact with the sidewall or those which do not have such requirements. In summary, the logging tool 50 is placed in the housing 40 shown in FIG. 2 and the various data observed by the logging tool 50 are provided to the telemetry system 48 which then converts the data into suitable formats for transfer to the surface. The housing 40 is surrounded with drilling mud to equalize pressure. No particular harm arises from entry of mud in view of the fact that the logging tool 50 is made of sealed components which exclude drilling mud. The logging tool carries a set of SP (spontaneous potential) contacts which are discussed below.

DETAILED DESCRIPTION OF THE PROTECTIVE HOUSING

Going now to FIG. 4 of the drawings the sectional view shows the orientation section 35 previously mentioned. The orientation section 35 is constructed with the locked stand off ring 34 attached in such a fashion that it is fixed to the entire drill string 10 thereabove. It cannot rotate because it is fixed on a telescoping sleeve 54 which is moved upwardly or downwardly. Rotation is forbidden in the down position by the interlocking position of the facing shoulders 55. The sleeve is constructed around an internal, elongate tubular sleeve 56 joined to the drill string above. The sleeve 56 is fixed to the drill string 10 above and moves with the drill string. The sleeve 56 is reduced in diameter to support a telescoping outer sleeve 57, the sleeve 57 being supported for rotation by means of spaced bearing assemblies at 58. The two bearing assemblies face one another and are constructed with radial thrust bearings to assure proper alignment with rotation of the telescoped components. In the annular space, a floating seal ring 59 is spring balanced upwardly and downwardly to assure pressure equalization of lubricant on one side of the floating seal ring 59. In other words, dynamic pressure observed at the depth in the borehole is transferred through the drilling mud into the annular space and acts on the seal ring 59 to thereby pressurize lubricant for the bearing assemblies 58. The bearings 58 are lubricated and maintained in a lubricant bath to avoid pollution with drilling mud from the exterior. Lubricant is contained in the system by the upper and lower seal assemblies. Lubricant is injected through a fill plug. The ambient mud pressure in the well assures pressurization of the lubricant captured in the annular space between the two members telescoped together.

Going now to FIG. 4 of the drawings, the sleeve 54 is mounted for telescoping movement upwardly and downwardly. It incorporates an inwardly projecting guide pin 60 which is received in an outwardly facing slot 61 formed in a transition crossover piece 62. At the upper end, the transition crossover 62 includes a threaded box end 63 which extends downwardly, reduces in diameter and threads to the internal sleeve 56. The hollow tubular members 56 and 62 connect together at a set of threads and thus move as a unit. A lengthwise slot 61 is formed in the exterior to receive the guide pin 60. The guide pin 60 is not permitted to rotate around the axis of the structure shown in FIG. 4; rather, the guide pin 60 is limited in movement to up and down movement. In the up direction, the sleeve 54 moves against the shoulder 64, and in the downward direction, it moves until the shoulder 55 accomplishes locking as will be described. The lengthwise slot or groove 61 is incorporated to guide the standoff ring 34 upwardly and downwardly, but not in rotation. In the up position as shown in FIG. 4, the drill string 10 can rotate in either direction whereupon the sleeves 56 and 57 can rotate independent of one another. When retreival of the drill string 10 is initiated as for instance in pulling the logging tools through a formation to be logged, the sleeve 54 is moved down relatively from the position shown in FIG. 4 to bring the abutting shoulders 55 into alignment for locking against one another. This movement assures locking, and then locks the sleeves 56 and 57 together. This locks the swivel action, preventing rotation, preventing any further rotation of the housing below the standoff 34 and securing the housing against further rotation.

Figure 5:
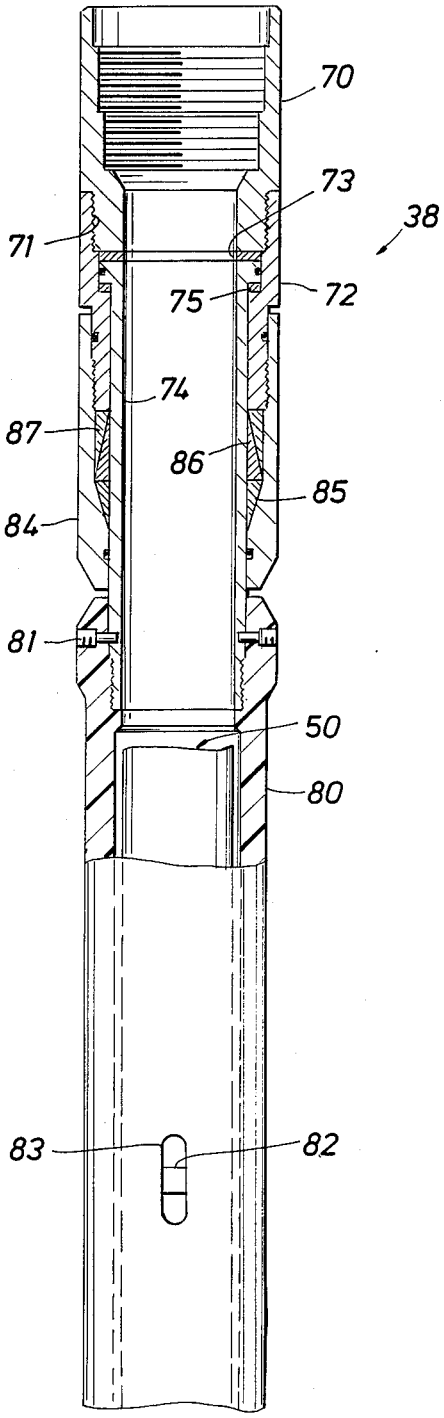
FIG. 5 is a sectional view through an alignment sub of the protective housing.

The numeral 66 identifies the lower abutting face of the sleeve 54 while the numeral 67 identifies the upper abutting face which is affixed to the sleeve 57 therebelow. It is possible that the abutting faces 66 and 67 will contact one another when retrieval is first initiated. If any further rotation occurs, they may rotate a portion of one revolution. Such rotation will however locate the shoulders 55 in abutting relationship. The faces 66 and 67 thus make contact and rotate against one another for a fraction of a revolution; alignment ultimately will occur and when that does, the faces 55 of the two shoulders will then abut locking the members against any further rotation. In FIG. 5 of the drawings, the shell 38 is shown in sectional view. FIG. 5 is that portion of the equipment which is just below the structure shown in FIG. 4 which is located just below the wet connector on the interior of the housing 40, see FIG. 2. The shell 38 is shown in FIG. 5. The shell is assembled in the following fashion. At the top of FIG. 5, a metal sub 70 is illustrated and has suitable internal threaded areas and shoulders for connection with the apparatus thereabove. The sub 70 has a threaded external surface 71 which is threaded to receive a stepped transition sleeve 72. The sleeve 72 captures a bearing ring 73. The bearing ring is material which is especially selected for slipperiness. The ring 73 abuts a metal tubular sleeve 74 which supports another bearing ring 75 made of similar slippery material. The two bearing rings assist in permitting relative rotation of the components as will be described. The sleeve 74 is quite long and extends downwardly to receive a fiberglas shell member 80. This is fastened to the sleeve by means of suitable set screws 81. Several are used to assure solid fastening. The set screws 81 fasten through an enlarged shoulder on the exterior of the member 80. When fastened, the sleeve 74 is fixed to the fiberglas member therebelow, and the components 74 and 80 rotate as a unit. Moreover, the sleeve 74 has an enlargement at the upper end which permits it to rotate contacting the two resilient bearing members 73 and 75. This permits relative rotation of the sleeve 80 around the logging tool 50 which is inserted on the interior. It is important that these two components be permitted to rotate. This permits relative rotation to assure that the SP electrodes 82 are aligned with the openings 83 permitted for the electrodes. In the preferred embodiment, there are several electrodes, typically four electrodes and they are spaced evenly around the circumference to match the openings 83. This permits the tool 50 to be rotated so that the SP electrodes contact through the opening 83. The electrodes have sufficient height that they are able to contact these adjacent formations to make SP measurements. [After rotation of the tool 50 inside the surrounding housing 80, it is desirable to lock these components together. Locking is accomplished by means of a locking sleeve 84 on the exterior. It bears against a circular tapered lock ring 85 which is adjacent to a second lock ring 86. They now are jammed together.] They bear against a tapered locking sleeve 87 which forces them into the sleeve into the sleeve 74 on the interior. In other words, the sleeve 74 is locked against further rotation so that all the components shown in FIG. 5 are then locked together. Release is accomplished by releasing the lock sleeve 84. It threads to the crossover sub 72. When it is unthreaded, slack is permitted in the components and they are free to rotate. This enables the tool 50 to be installed in the surrounding housing 38, and the housing rotated thereabout so that the SP electrodes are properly exposed. In summary, the housing 38 shown in FIG. 5 is releasably positioned around the logging tool 50, rotational registration is achieved and then the two are locked together. Referring back now to FIGS. 2 and 3 jointly, it will be recalled that the logging tool 50 (made up of multiple sections) is installed inside the housing 40 shown in FIG. 2 and is adapted to be run in open hole for logging especially in a highly deviated situation. The particular arrangement shown in FIGS. 2 and 3 is thus implemented by the structures shown in FIGS. 4 and 5 jointly which permit selective rotation of the tool 50 inside the housing 40 to achieve rotational alignment, and which also permits telescoping movement of the standoff 35 and the requisite locked non-rotational movement resulting from that. In summary, this prepares the logging tool 50 for use inside the housing 40.

DESCRIPTION OF OPERATION

The description set forth below relates to operation of the entire system in a deviated well. Assume for purposes of description that the drill string has been pulled completely from the well prior to logging of a zone of interest. Assume further that the zone of interest is 1,000 feet in length along the deviated well and begins at a depth of 10,000 feet in the well and extends to 11,000 feet. Assume further that the well is highly deviated so that gravity will not draw the logging tool through the zone of interest. Further, assume that the well has been cased to a depth of at least 1,000 feet. In this circumstance, the following sequence of operations is undertaken. First of all, the logging tool 50 shown in FIG. 3 is assembled (actually comprising a number of individual logging systems). The tool 50 can include the various components as shown in FIG. 3 but it can be altered from that particular deployment of logging instruments. The logging tool 50 is assembled in the housing 40 shown in FIG. 2. The protruding arm 43 is located opposite the slot 42 while the projecting pad 44 is positioned adjacent the slot 45 where in the housing. The SP Contacts 82 are positioned in the slots 83. The various rotating standoffs 41 are free to rotate. The logging tool 50 is connected with the male wet connector. The equipment included in the protective housing 40 is assembled below the orientation sub assembly 35 adjacent to the locking standoff assembly 34. In turn, that is connected with a string of drill pipe 10 to enable the logging tool to be pushed into the well.

Joints of drill pipe are added until the logging tool is located at a depth of 10,000 feet. At this juncture, the side entry sub 22 shown in FIG. 1 is assembled in the drill string. The logging cable 15 is routed from the exterior of the drill string; through the side entry sub to support the female connector 30 shown in FIG. 1 with the associated weight bar 29 and lower part of the cable suspended on the interior of in the drill string. Additional drill pipe is added until the logging tool 50 has been shoved by the drill pipe 10 to a depth of 11,000 feet in the well. At this juncture, the drill pipe has pushed the logging tool beyond the zone of interest. Logging is thereafter accomplished during withdrawal. At the time the side entry sub is placed in the drill string, the logging cable 15 is on the exterior of the drill pipe 10 at the top of the cased well. The wet connector is pumped down for connection. The necessary additional pipe is added thereafter to shove the logging tool 50 past the zone of interest. The side entry sub at this point is located about 1,000 feet below the well head.

Mud is pumped through the drill string to act on the piston 28 to force the female wet connector 30 through the drill string. It is forced through the pipe string until it passes through the orientation sub assembly 35 and into the centralization section 36. It is pressure driven into immediate contact with the male wet connector.

During the insertion of the drill string by forcing it into the well, no rotation is applied. None is needed and there is no advantage to rotating. As the well deviates, the protective housing 40 points into the deviated section from the vertical and will eventually arrive at the zone of interest and travel to the far side of the particular zone (1,000 feet in thickness in this example). During this maneuver where the housing 40 moves from the original vertical position at the well head into a highly deviated position dependent on the pathway of the well, the housing 40 (equipped with the weights 39) seeks a position relative to the vertical wherein the weights are at the bottom of the hole. In other words, the housing 40 aligns and settles against the bottom side of the hole, and the clearance between the housing 40 and the hole is above the tool. Such positioning is permitted by operation of the orientation sub assembly 35. At this time, the locking standoff assembly 34 is pushed upwardly. The rotary standoffs are free to rotate at this stage. Indeed, the housing 40 is supported on the rotating standoff assemblies so that the exterior is not scuffed.

Eventually, the housing 40 arrives at the far side of the zone of interest. When the first retraction movement occurs (occasioned by retrieval of a few feet of the drill string), the locking assembly 34 locks the facing shoulders 55 constructed therewith. The rotating standoffs 41 likewise lock. Recall, however, that they are constructed to permit ratcheting movement. They are in contact with the sidewall, but, since the tool is now more aptly on its side, the rotary standoffs 41 actually hold the housing 40 slightly above the bottom sidewall of the hole. In other words, the tool is now more or less horizontal (depending on the angle of deviation) and is resting on the rotary standoffs along the length of the tool. At this juncture, the housing 40 has settled to the bottom of the hole and is no longer precisely centralized, but this is desirable so that all modes of testing procedures can be undertaken. In this state of affairs, the logging tool 50 within the housing 40 is then ready to be operated.

Recall that the female connector 30 is pumped down. Recall also that it is submerged in drilling fluid which completely fills the drill string and surrounds the male wet connector 70. The two connectors are brought toward one another.

At this point, electrical power can be applied through the system and into the logging tool 50. As appropriate, the arm 43 can be extended and the pad 44 activated so that they are in proper position for operation. Logging can then begin as the tool is pulled out of the zone of interest. In the example given, the tool must travel 1,000 feet or back to a depth of 10,000 feet in the well to complete logging of the zone of interest. The SP log is made also. Logging is completed as the drill string is removed joint by joint at the well head. As the drill string is pulled from the well, the logging cable is also pulled from the well, but it does not get in the way of removal of each joint of the drill string. This continues joint by joint until the drill string is disassembled above the side entry sub. When the side entry sub reappears at the well head, it is an indication that the zone of interest has been logged. It should be recalled that the zone of interest was 1,000 feet in width and that the side entry sub was located about 1,000 feet into the well by assembly of the drill string thereabove. The side entry sub is removed after unlatching the wet connectors and the logging cable is pulled with retraction to the side entry sub. This pulls the wet connector 30 out of the drill string. Thereafter, the only apparatus remaining in the well is the drill string below the side entry sub (without cable). The remaining pipe can be easily removed, and thereafter the logging apparatus is retrieved. The arm 43 protrudes because it normally extends outwardly during the logging sequence, but is typically electrically actuated so that it retracts. In like fashion, the rotary standoffs are locked against rotation, but this poses no problem during retrieval because the tool travels from the highly deviated position (where logging occurred) to hang vertically in the well where the rotary standoffs are not operative. The equipment more or less hangs free of contact with the sidewall of the borehole.

While the foregoing is directed to the preferred embodiment, the scope thereof is determined by the claims which follow.

What is claimed is:

1. A method of logging highly deviated well boreholes comprising the steps of:

(a) mounting a logging tool on the end of a drill string;

(b) pushing the logging tool along the deviated borehole past a zone of interest wherein the logging tool is permitted to move against the low side of the well borehole;

(c) placing a weight along one side of the logging tool to cause the logging tool to rotate below a connector thereof by gravity to the low side of the deviated well borehole;

(d) pulling the logging tool on the drill string past the zone of interest without rotating the drill string from the top of the well borehole;

(e) locking the rotated logging tool against relative rotation after the start of pulling the logging tool wherein the logging tool is rotated to the low side to a locked position by the weight; and (f) performing logging operations in the zone of interest with the logging tool at a fixed rotational position during pulling of the logging tool through the zone of interest.

2. The method of claim 1 including the steps of:

(a) placing the connector between the logging tool and drill string to enable rotation about an axis along the drill string;

(b) wherein said rotating connector has first and second operative position, being (1) a raised unlocked position, and (2) a lowered locked position;

(c) shifting said rotating connector to the unlocked position during the step of pushing the logging tool past the zone of interest; and (d) during the step of pulling the logging tool through the zone of interest, shifting said rotating connector to the lowered position to prevent rotation thereof.

3. The method of claim 2 wherein at least two locked standoff means are located along said logging tool at spaced locations, and including the step of independently operating said standoff means to lock and thereby prevent logging tool rotation.

4. The method of claim 2 including the step of locking said logging tool on movement of said rotating connector.

5. The method of claim 1 including the steps of:

(a) positioning a wet connector at the lower end of the drill string connected with the logging tool;

(b) connecting a side entry sub in the drill string at the well head;

(c) extending a logging cable on the exterior of the drill string from the well head and through the side entry sub into the drill string;

(d) supporting a mating and cooperative wet connector on the logging cable below the side entry sub;

(e) pumping the mating connector and connected logging cable down through the drill string to bring the mating connector into contact with the connector in the drill string;

(f) connecting the two connectors together; and (g) thereafter pulling the logging tool past the zone of interest while performing logging operations.

6. The method of claim 5 further including the step of adding drill pipe above the side entry sub after the logging cable has been connected with the logging tool through the mated connectors, wherein the addition of drill pipe at the well head to the drill string pushes the logging tool along the borehole.

7. The method of claim 6 including the step of casing the well borehole to a specified depth prior to placing the logging tool in the well borehole, and extending the logging cable outside of the drill string to a depth not exceeding the depth of the cased portion.

8. An apparatus for logging a zone of interest beyond a deviated portion of a deviated well borehole, the apparatus comprising:

(a) selectively locked means for mounting a logging tool on the end of a drill string at a locked rotated position;

(b) weight means along one side of the logging tool to enable the logging tool to be rotated by gravity relative to the low side of the deviated well borehole;

(c) means around said logging tool to mount said logging tool wherein the standoff means controllably permits rotation and wherein said mounting means moves upwardly on running in of the drill string, and said mounting means moving downwardly to a locking position joining said logging tool to said drill string; and (d) separate male and female connectors serially connected on a logging cable and on said logging tool for controllable connection and disconnection to permit logging of the zone of interest by said logging tool wherein data from the logging tool is provided on the logging cable through said mated connectors during retrieval of said logging tool past the zone of interest.

9. The apparatus of claim 8 wherein said logging tool is received in a cylindrically aligned housing means surrounding concentrically said logging tool and said housing is serially connected with said drill string.

10. The apparatus of claim 9 wherein said housing means incorporates opening therein exposing SP contacts from said logging tool to contact the well borehole in the zone of interest.

11. The apparatus of claim 8 including a side entry sub in said drill string for receiving said logging cable therethrough.

12. The apparatus of claim 8 wherein said mounting means comprises;

(a) an elongate sleeve about said drill string;

(b) an internally directed guide means on said sleeve;

(c) fixed cooperative coacting second guide means on said drill string cooperative with said guide means of permitting upward and downward movement along said drill string;

(d) a rotatable sleeve connected to said logging tool for rotation therewith;

(e) second means mounting said rotatable sleeve for rotation; and (f) locking means operated by said elongate sleeve for locking said rotatable sleeve against rotation when said elongate sleeve moves downwardly.

13. The apparatus of claim 12 wherein said locking means includes first and second shoulders in locking relationship to forbid rotation of said rotatable sleeve.

14. An apparatus for locking an external protective housing around an elongate logging tool comprising;

(a) an elongate hollow housing;

(b) a sleeve extending from said housing and joined thereto for joint rotation therewith;

(c) an upper surrounding fitting around said sleeve;

(d) expansion ring means between said fitting and said sleeve; and (e) adjustable tightening means pressing on said ring means to tighten said adjustable means and said ring means for locking said fitting and said sleeve together.

15. The Apparatus of claim 14 wherein said housing is formed of electrically insulating material.

16. The apparatus of claim 14 wherein said housing includes opening means therein to enable signal forming means to operate therethrough.

17. The apparatus of claim 14 wherein said housing encloses the logging tool and rotates only therewith.

18. The apparatus of claim 14 wherein said ring means includes a pair of adjacent tapered surface rings.

19. The apparatus of claim 14 wherein tightening means comprises a hollow threaded nut movable into said ring means.

20. The apparatus of claim 14 including bearings enabling said sleeve to rotate in said upper fitting.

* * * * *